US008813661B2

(12) United States Patent
Fakahany et al.

(10) Patent No.: US 8,813,661 B2
(45) Date of Patent: Aug. 26, 2014

(54) TIERED SERVING TRAY

(76) Inventors: Ahmass Fakahany, New York, NY (US); Michael White, New York, NY (US); Franco Rosignolo, New York, NY (US)

( * ) Notice: Subject to any disclaimer, the term of this patent is extended or adjusted under 35 U.S.C. 154(b) by 89 days.

(21) Appl. No.: 13/600,751

(22) Filed: Aug. 31, 2012

(65) Prior Publication Data

US 2014/0060398 A1 Mar. 6, 2014

(51) Int. Cl.
*A47B 57/00* (2006.01)

(52) U.S. Cl.
USPC ..... 108/92; 108/42

(58) Field of Classification Search
USPC ..... 108/91, 90, 92, 93, 94, 95, 96
See application file for complete search history.

(56) References Cited

U.S. PATENT DOCUMENTS

| | | | | | |
|---|---|---|---|---|---|
| 2,143,592 | A | * | 1/1939 | Baldeck | 211/134 |
| 2,244,861 | A | * | 6/1941 | Walker | 108/44 |
| 3,951,079 | A | * | 4/1976 | Tolleson | 108/94 |
| 4,227,467 | A | * | 10/1980 | Kindsfather | 108/101 |
| D284,336 | S | * | 6/1986 | Berry, Jr. | D6/430 |
| D287,796 | S | * | 1/1987 | Evans | D6/483 |
| D299,092 | S | * | 12/1988 | Leolli | D6/474 |
| 5,088,420 | A | * | 2/1992 | Russell | 108/106 |
| D413,046 | S | * | 8/1999 | Fritze | D7/610 |
| 6,240,857 | B1 | * | 6/2001 | Elizer | 108/152 |
| 6,374,555 | B1 | * | 4/2002 | Gusler | 108/90 |
| D475,560 | S | * | 6/2003 | Suero, Jr. | D6/525 |
| 6,688,238 | B1 | * | 2/2004 | Alexiou | 108/42 |
| 6,688,239 | B1 | * | 2/2004 | Pettini et al. | 108/50.11 |
| 6,739,271 | B1 | * | 5/2004 | Hancock | 108/90 |
| D571,575 | S | * | 6/2008 | Hunter | D6/455 |
| D587,254 | S | * | 2/2009 | Morello | D14/239 |
| 7,950,335 | B1 | * | 5/2011 | Almond et al. | 108/42 |
| 8,276,524 | B2 | * | 10/2012 | Goode et al. | 108/94 |
| 8,490,553 | B1 | * | 7/2013 | English et al. | 108/101 |
| D697,341 | S | * | 1/2014 | Fakahany et al. | D6/677.3 |

* cited by examiner

*Primary Examiner* — Jose V Chen
(74) *Attorney, Agent, or Firm* — Meister Seelig & Fein LLP

(57) ABSTRACT

A tiered tray is provided that includes a first tier with a first support member coupled thereto; a second tier with a second support member coupled thereto; and a table insert having a cavity therein that accepts at least one of the first and the second support members. The first support member maintains a level of the first tier above a level of a table and the second support maintains a level of the second tier above the level of the first tier, and the first tier is removably attachable to the table insert and the second tier is removably attachable to the first tier.

19 Claims, 11 Drawing Sheets

(Section A-A)

(Detail B)

(Detail C)

(Detail D)

TIERED SERVING TRAY

BACKGROUND

The present application relates to serving trays, more particularly multi-tiered serving strays.

A number of tiered serving trays exist. For example, D577,962 depicts a tiered serving tray that includes a plurality of concentrically stacked plates. Similarly, U.S. Pat. No. 4,823,966 depicts a plurality of stacked supporting rings that accept conventional serving plates. These designs have numerous shortcomings. Specifically, each requires a lower serving plate or ring, which when placed on a table reduces the available surface area of the table. Moreover, each has limited capacity that is defined by the size of the plate or ring. Accordingly, there is a need for a tiered serving tray that is not so limited.

SUMMARY

In one aspect, a tiered tray is provided that includes a first tier with a first support member coupled thereto; a second tier with a second support member coupled thereto; and a table insert having a cavity therein that accepts at least one of the first and the second support members. The first support member maintains a level of the first tier above a level of a table and the second support maintains a level of the second tier above the level of the first tier, and the first tier is removably attachable to the table insert and the second tier is removably attachable to the first tier.

In one embodiment, the support members are fixed to their respective tiers.

In one embodiment, the first support member maintains the first tier from about 6" to about 12" above the level of the table.

In one embodiment, the second support member maintains the second tier from about 3" to about 9" above the level of the first tier.

In one embodiment, the tray does not include a tier at the level of the table.

In one embodiment, the first and second tiers are usable independently and in combination.

In one embodiment, at least one of the first and the second tiers have a circular, planer structure.

In one embodiment, the first tier has a diameter from about 6" to about 14" and the second tier has a diameter of about 6" to about 10".

In one embodiment, at least one of the first and the second tiers are unobstructed along a planer support surface of the structure.

In one embodiment, wherein the first and second tiers are usable independently and in combination, and wherein when used independently both tiers are unobstructed horizontally and when used in combination at least the second tier is unobstructed horizontally.

In one embodiment, the insert is recessed and bonded to a table top.

In one embodiment, the insert comprises a retractable aperture cover that covers an opening in the insert when not in use.

In one embodiment, at least one of the first tier is removably attachable to the table insert and the second tier is removably attachable to the first tier with a vertically oriented slip connection.

In one embodiment, the tray further includes an oblong extension plate having a lower surface with a recess therein that fits over at least one of the first tier and the second tier and that prevents lateral movement in the extension plate when placed over the at least one of the first tier and the second tier.

In one embodiment, the at least one of the first tier and the second tier have a circular planer structure, and wherein the recess has a shape comprising a pair of overlapping circles, each of the circles having a diameter slightly greater than a diameter of the at least one of the first tier and the second tier.

In one embodiment, the extension plate comprises a keyway that accommodates the second support.

In one embodiment, the extension plate has a major axis and a minor axis, and wherein a dimension of the plate along the major axis is from about 8" to about 16", and the dimension of the plate along the minor axis is about 8" to about 14".

In aspect, a tiered tray is provided that includes a first tier having a circular planer structure with a first support member fixed thereto; a second tier having a circular planer structure with a second support member fixed thereto; a table insert having a cavity therein that accepts at least one of the first and the second support members; and an oblong extension plate having a lower surface with a recess therein that fits over at least one of the first tier and the second tier and that prevents lateral movement in the extension plate when placed over the at least one of the first tier and the second tier. The first support member maintains a level of the first tier above a level of a table and the second support maintains a level of the second tier above the level of the first tier, the first tier is removably attachable to the table insert and the second tier is removably attachable to the first tier, the tiers removably attachable with a vertical slip connection, and the first and second tiers are usable independently and in combination, and when used independently both tiers are unobstructed horizontally and when used in combination at least the second tier is unobstructed horizontally Additional aspects of the present invention will be apparent in view of the description which follows.

DETAILED DESCRIPTION

Figure 1:
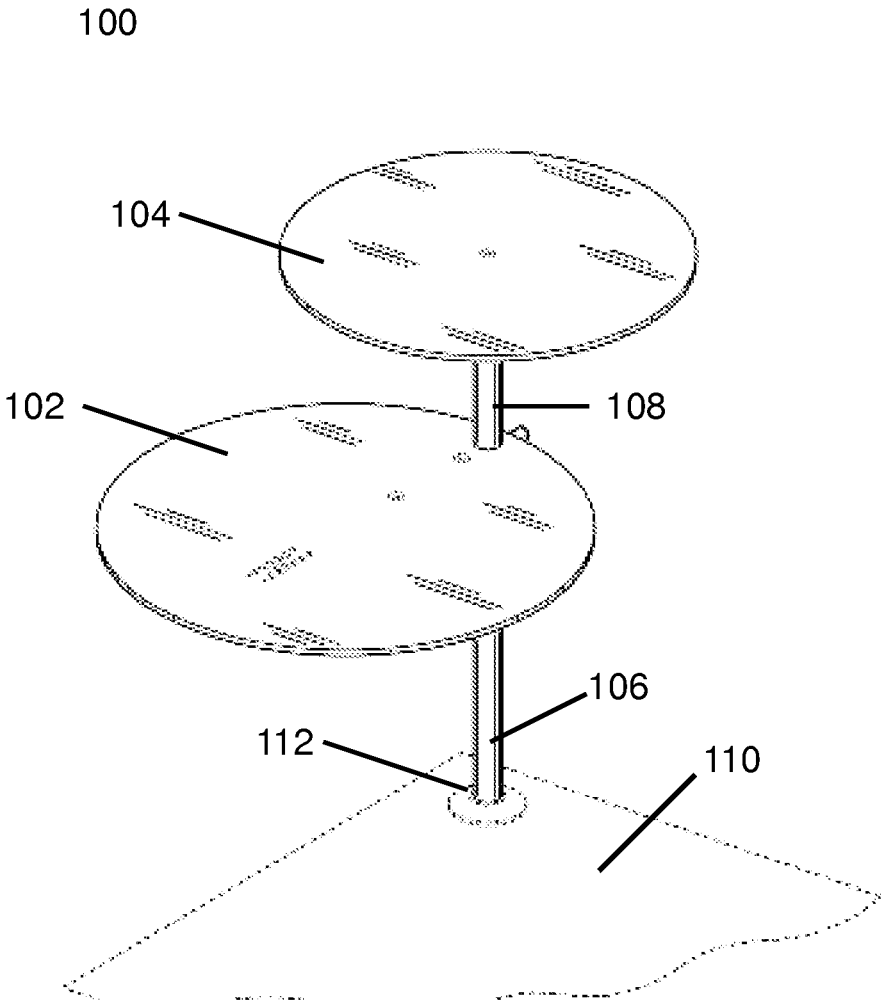
FIG. 1 depicts a perspective view of a tiered serving tray according to one embodiment of the trays discussed herein.
Figure 2:
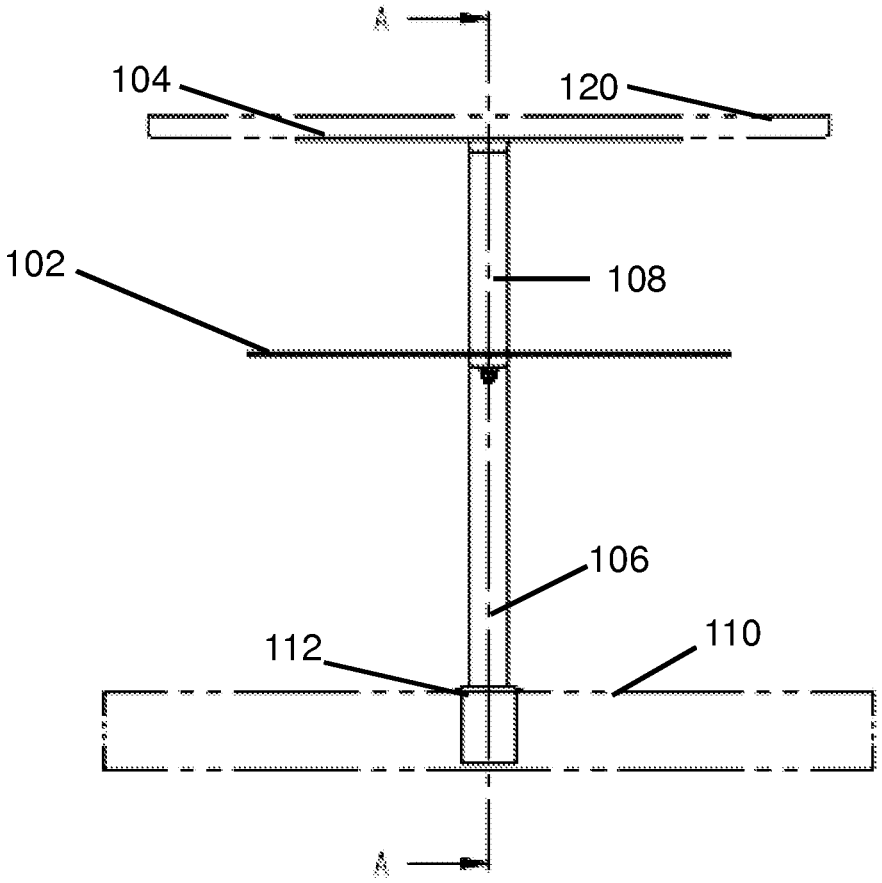
FIG. 2 depicts a front view of a tiered serving tray according to one embodiment of the trays discussed herein.
Figure 3:
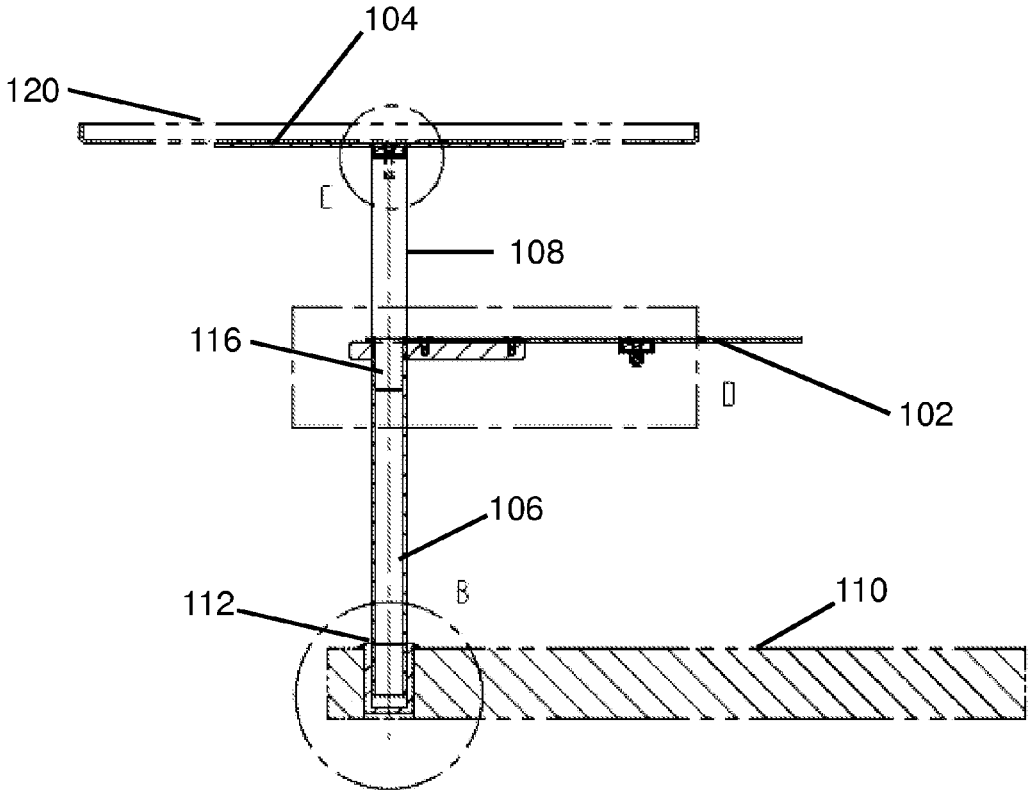
FIG. 3 depicts a side view of a tiered serving tray according to one embodiment of the trays discussed herein.

Referring to FIGS. 1-3, the tiered tray 100, according to one embodiment, includes a first tier 102 that is fixed to a first support member 106, and a second tier 104, fixed to a second support member 108. The first support member 106 maintains the level of the first tier 102 above the level of the table 110, e.g. from about 6" to about 12" above the table 110. The second support member 108 similarly maintains the level of the second tier 104 above the level of the first tier 102, e.g. from about 3" to about 9" above the first tier 102. In at least one embodiment, the tray 100 does not include a tier at the same level of the table 110. This beneficially frees the surface area of the table for other items. The tray 100 is preferably removably attachable to the table 110, and the first and second tiers 102, 104 are removable attachable to each other. This allows either of the first and second tiers 102, 104 to be used independently from each other. For example, a user may attach the first tier 102 to the table without the second tier 104, the second tier 104 to the table without the first tier 102, or may attach both tiers to the table in a vertical stack as shown in the accompanying figures.

Figure 7:
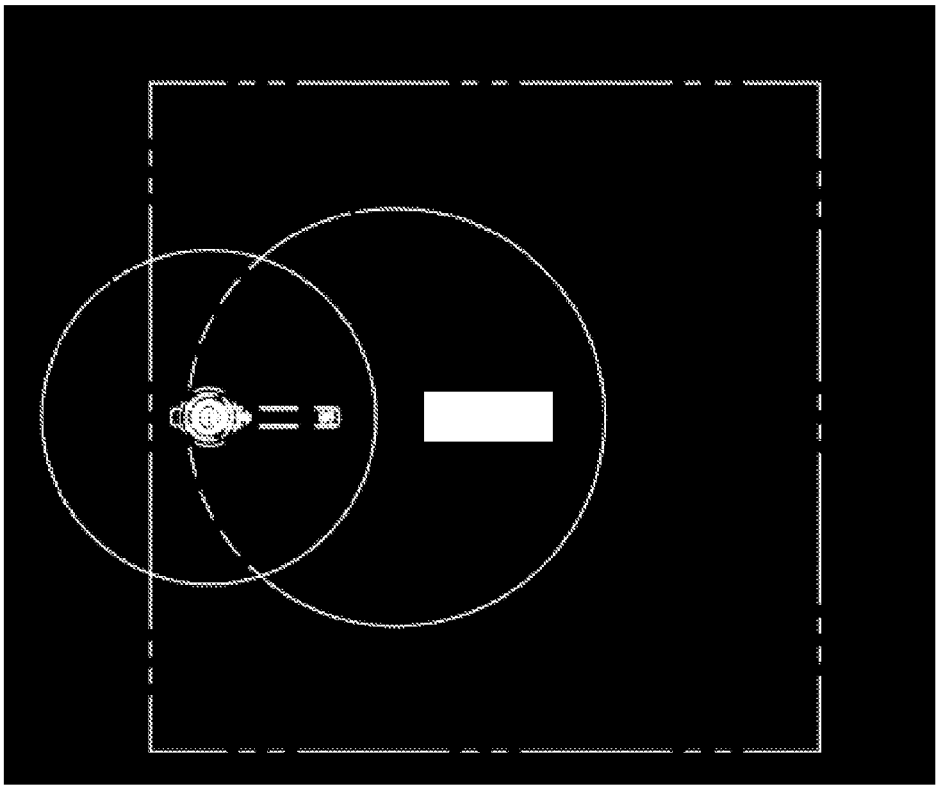
FIG. 7 depicts a top view of a tiered serving tray according to one embodiment of the trays discussed herein.
Figure 8:
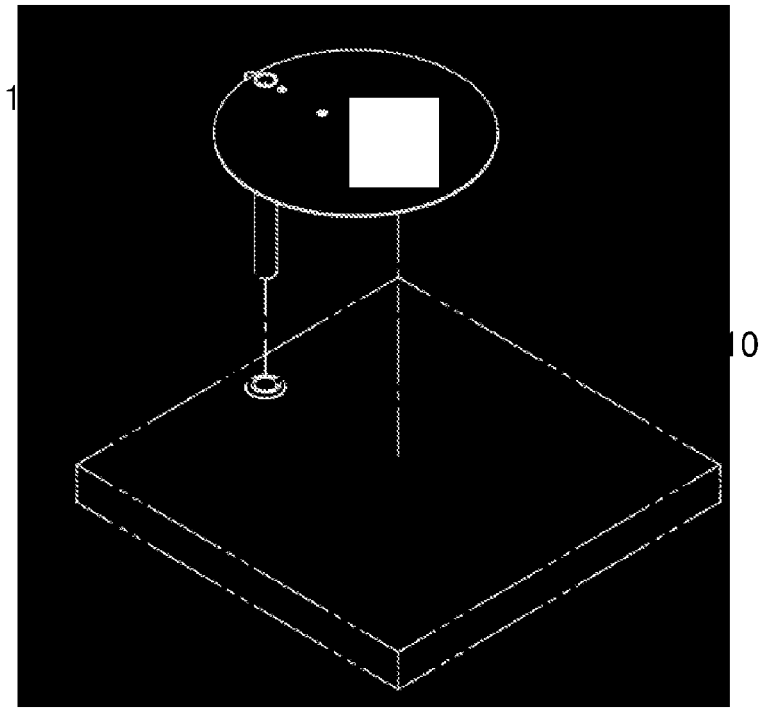
FIGS. 8-12 depict a tiered serving tray according to one embodiment of the trays discussed herein in various stages of assembly.
Figure 9:
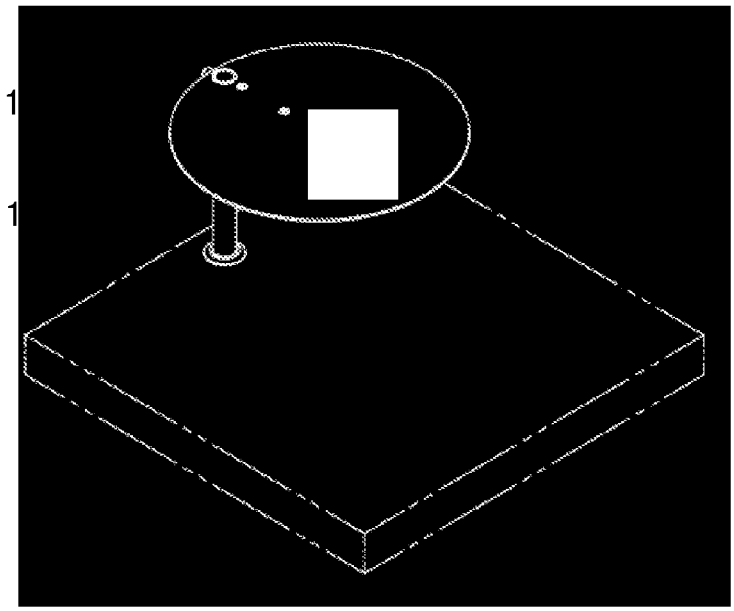
Figure 12:
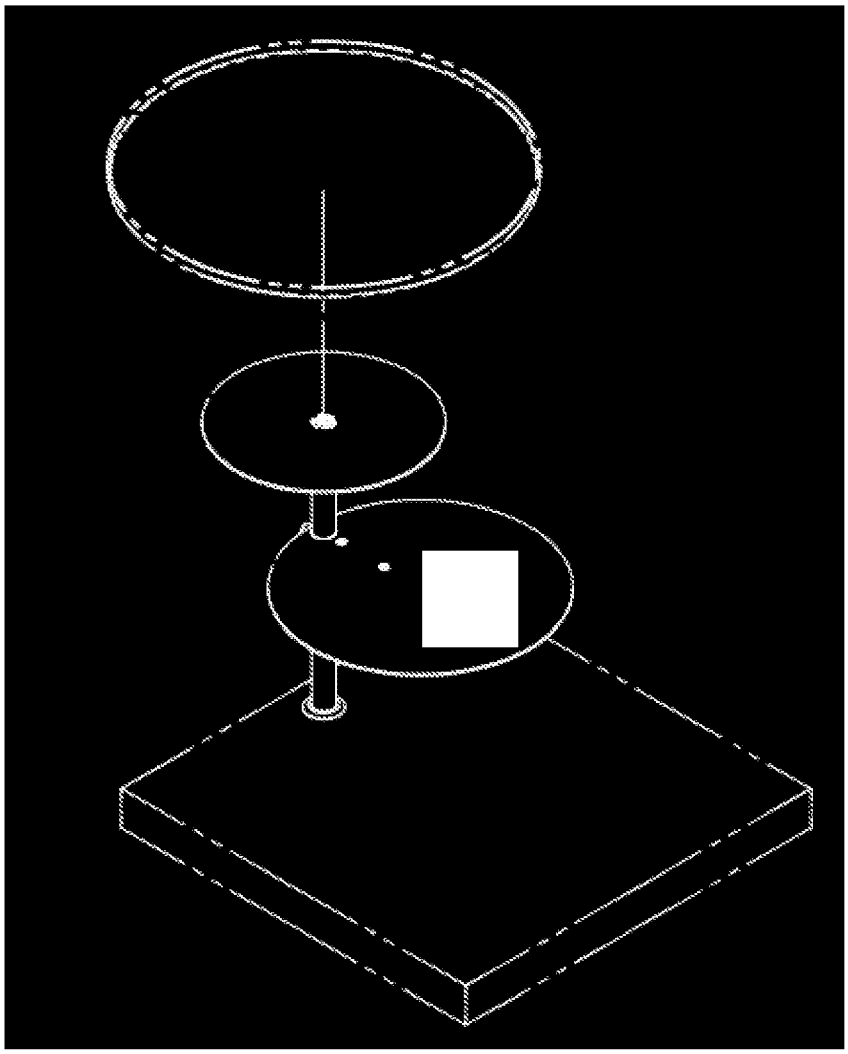

It is understood that the shape and size of the tiers may vary. For instance, the tiers may have a circular shape, as shown, elliptical, square, rectangular, or any desired shape. The upper tier 104 may be circular with a diameter from about 6" to about 10", or greater. The lower tier 102 may also be circular with a diameter from about 6" to about 14", or greater. In at least one embodiment, one or more of the tiers 102, 104 have a horizontal planer structure, for supporting serving dishes or platters 120, that is generally unobstructed along the planer support surface of the structure. In this regard, at least one of the tiers 102, 104 is constructed so that there is essentially no obstruction on the support surface to limit the size of the serving platter than can be placed on the tier(s). For example, the upper tier 104 may be a circular plate without any structure protruding upward above the support surface of the circular plate, as shown. In this instance, there is essentially no limit imposed by the tray 100 on the size of the serving dish that may be placed on the upper tier 104, and a plate larger than the support surface area of the upper tier 104 may be placed thereon, as shown in FIGS. 2-3, and 12. The lower tier 102 preferably has the same capability when installed on the table 110 alone, as shown in FIGS. 8-9. The tiers 102, 104 may be stacked concentrically or asymmetrically, as shown in FIG. 7.

Figure 4:
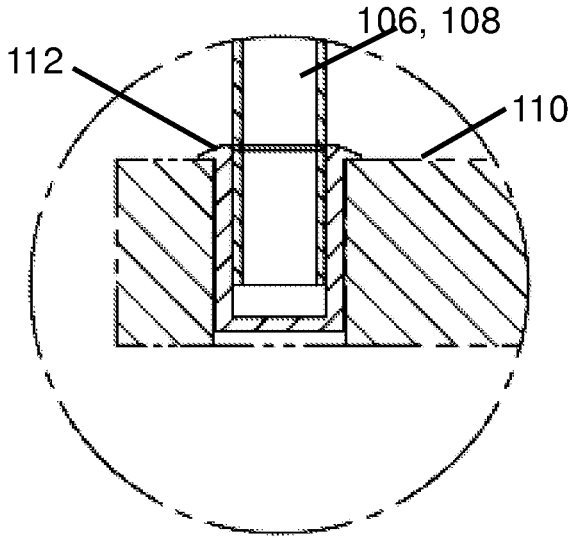
FIGS. 4-6 depict cross sections of the tiered tray according to one embodiment of the trays discuss herein.
Figure 16A:
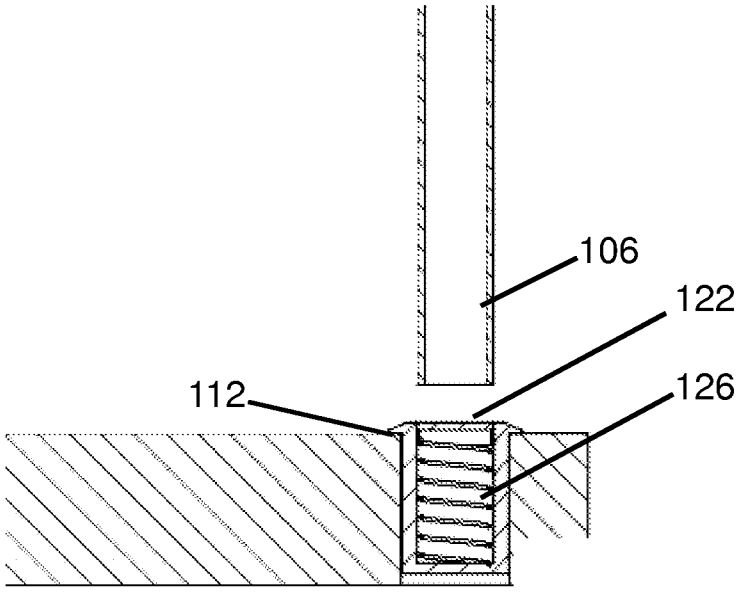
FIGS. 16A-B depict cross sections of a table insert for removably attaching a tiered tray according to one embodiment of the trays discussed herein to a table.
Figure 16B:
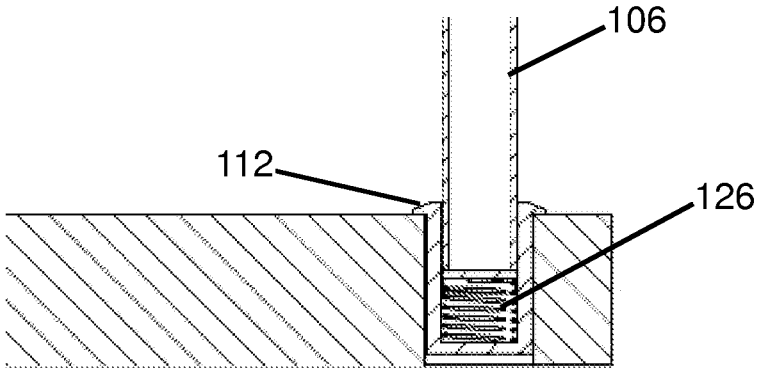

Referring to FIG. 4, in one embodiment, the tray 100 is removably attachable to the table 110 using a table insert 112. The table insert 112 generally has an aperture therein, e.g., a circular opening with a diameter of about 0.5" to about 1.5", with a vertical side or sides, and a bottom that receive the first or the second support members 106, 108. Once received into the cavity defined by the bottom and vertical side(s), the insert 112 maintains the vertical orientation of the support members 106, 108 inserted therein. The insert 112 is preferably made from a material having sufficient bearing capacity to support the tray 100 and any serving plates placed thereon. For example, the insert 112 may be made from metal, such as stainless steel, aluminum, brass, etc. The insert 112 may be formed integrally into the table 110, e.g., into a stainless table top, or may be installed/bonded separately into the table 110, e.g., into a wood or stone table top. The insert 112 preferably includes a retractable aperture cover 122 that covers the aperture in the insert 112 when not in use, as shown in FIGS. 16A-16B.

Figure 5:
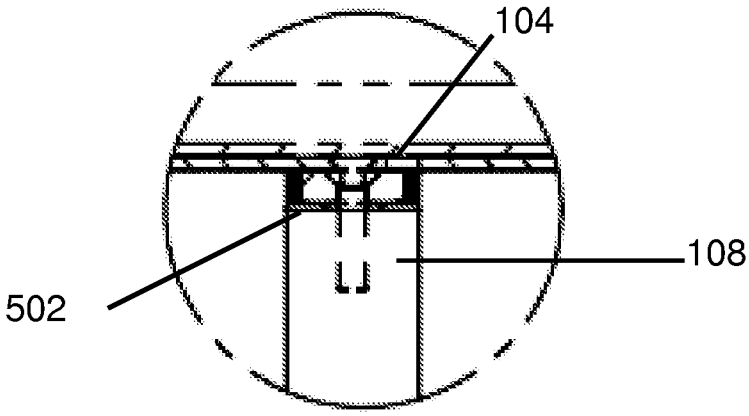
Figure 6:
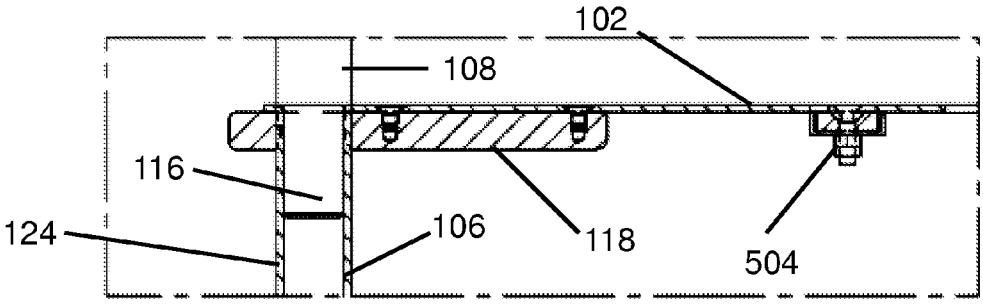

Referring to FIGS. 5-6, the tiers 102, 104 are preferably fixed to the respective support members 106, 108. For example, the upper tier 104 may be fixedly attached to the upper support 108, by screwing the planer structure at the center point thereof to the upper support 108, as shown. In this regard, the upper tier 104 and the upper support 108 are an integral construction. In one embodiment, the lower tier 102 is mounted to the lower support 106 off center, as shown. In this instance, the support member 106 may further include a strut 118 extending therefrom to provide cantilever type support for the upper tier 104. The lower tier 102 may therefore be fixedly attached to the support 106 and/or the strut 118, in an integral construction. In at least one embodiment, at least one of the tiers 102, 104 include an element for removably securing a metallic dish to the respective tiers 502, 504. For example, a magnetic element 502 may be installed between the upper tier 102 and the upper support 108, as shown in FIG. 5. Similarly, a magnetic element 504 may be installed flush with the surface of the lower tier, as shown in FIG. 6.

Figure 10:
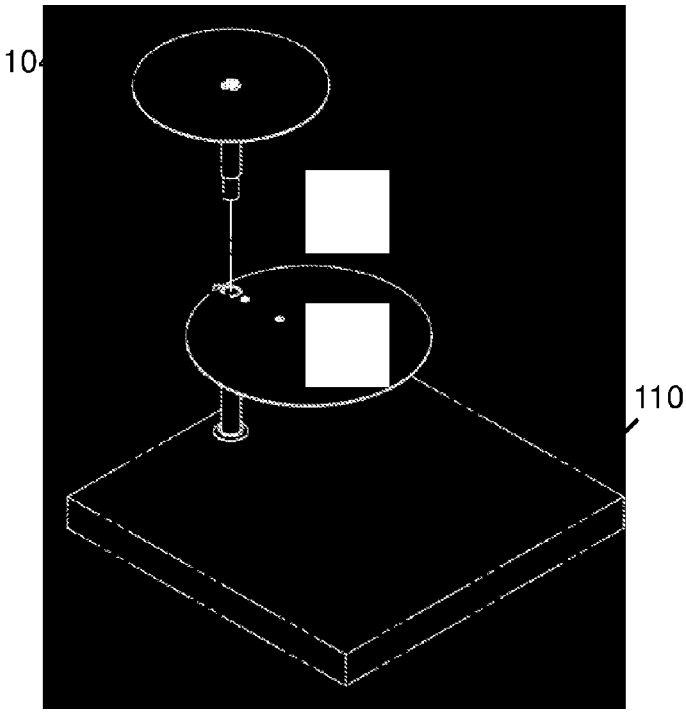
Figure 11:
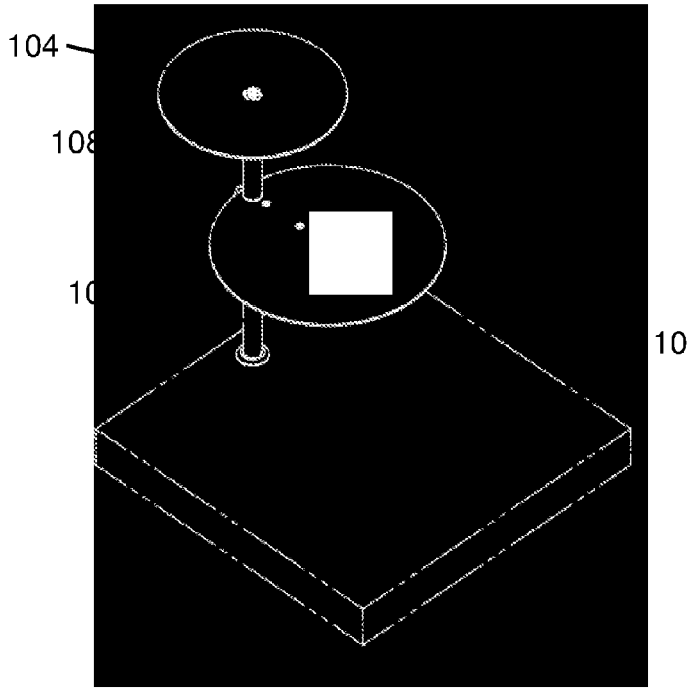

As discussed above, the tiers 102, 104 are removably attachable to each other. This may be accomplished in a variety of ways. In one embodiment, the upper support 108 is a rod and the lower support 106 is a tube, and the upper support 108 includes a lower section 116 having dimensions in cross section smaller than the internal dimensions of the tubular cross section of at least an upper section 124 of the lower support 106 to form a slip connection there between, as shown in FIG. 10. A stop may be included in either the upper support 108 or the lower support 106, to prevent the upper support 108 from sliding into the lower support 106 beyond the desired amount. In one embodiment, the height of the lower section is about 0.5" to about 1.5", and has a circular cross section with a diameter from about 0.5" to about 1". The internal dimensions of the upper section 124 may have a diameter from about 0.6" to about 1.5".

Referring to FIGS. 8-12, the tray 100 may be installed on a table 110 to provide additional surface area thereto. The table 110 generally includes therein the insert 112, with the cover 122 essentially flush with the insert 112. When additional surface area is needed or desired, the support member 106/108 of either of the upper tier 102 or lower tier 104 assemblies may be inserted through the aperture and into the cavity of insert 112, which pushes the cover 122 lower into the cavity of the insert 112, as shown in FIGS. 16A-16B. If both tiers are to be installed, the lower tier 102 may be installed first, followed by the upper tier 104. As can be seen, with both installed, the upper tier 104 is unobstructed horizontally. With only the lower tier 102 installed, the lower tier 102 is unobstructed horizontally. Once assembled, a plate 120 may be placed on the upper tier 104, lower tier 102, or both. As indicated above, the tiers 102, 104, may include magnetic or other elements 502, 504 that removably secure a metallic (ferrous) plate 120 to the respective tier, to prevent the plate 120 form falling of a tier. To disassemble the tray 100, the upper tier 104 and/or the lower tier 102 are lifted vertically out from the respective openings in the lower support member and in the table insert 112. Once the weight of the tray 100 is removed from the cover 122, the cover 122 returns to the upper most position in the insert 112 with the force applied by spring 126, as shown in FIGS. 16A-16B.

Figure 13:
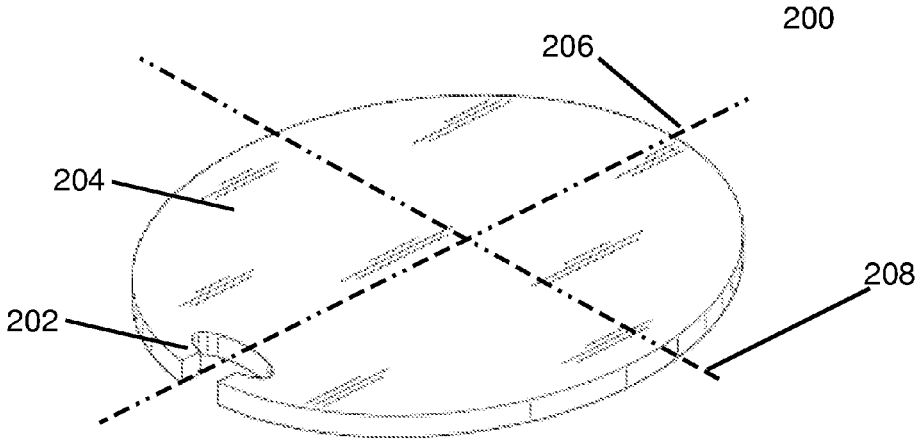
FIGS. 13-14 depict top and bottom perspective views of an extension plate according to one embodiment of the trays discussed herein.
Figure 14:
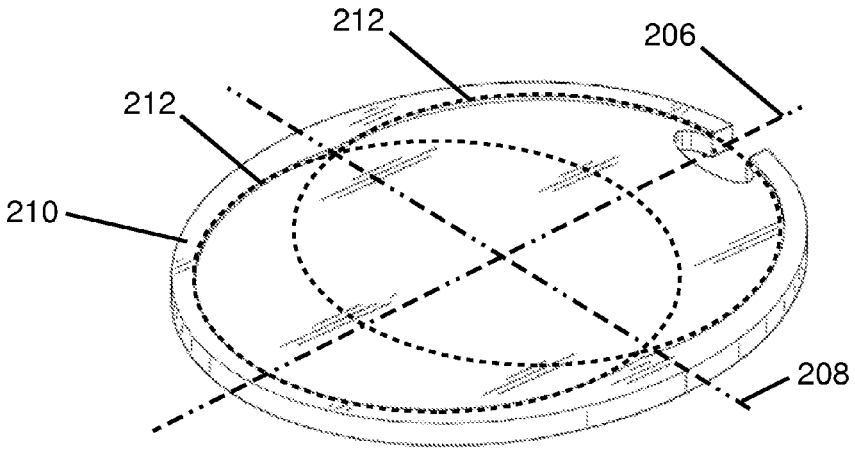

Referring to FIGS. 13-14, in one embodiment, the tiered tray 100 includes an extension plate 200. The plate 200 has an upper surface 204 with an oblong shape, for example, an elliptical shape. The oblong shape has a major axis 206 and a minor axis 208. The upper surface 204 is essentially symmetrical relative to major axis 206 and/or minor axis 208. In one embodiment, the dimension of the plate along the major axis is about 8" to about 16", and the dimension of the plate along the minor axis is about 8" to about 14". In one embodiment, the plate 200 includes a keyway 202 at one end of the plate along the major axis 206, shown in FIG. 13. The plate 200 has a lower surface 210, opposite the upper surface 204. The lower surface 210 preferably includes therein a recess 212 that has a shape that accepts the lower and/or upper tiers 102, 104 and that prevents lateral movement in the plate 200 when placed over the lower and/or upper tiers 102, 104. That is, the recess 212 is a planer indentation in the lower surface 210 of the plate 200 that has a shape and size slightly larger than at least the lower tier 102. For example, the recess 212 may be a circular cutout in the lower surface 210 having a slightly larger diameter, e.g., from about 1/16" to about 1/8" larger, that the diameter of the lower tier 102 and/or the upper tier 104, or both. In this regard, the recess 100 arrests essentially all lateral movement relative to the lower tier 102 when the recess 212 is placed over the lower tier 102. The recess 212 may be located centrally or biased toward one end of the oblong shaped plate 200. For example, the recess 212 may be located closer to the keyway 202 to accommodate the upper support 108. When used in combination with the upper support 108, the keyway 202 prevents the plate 200 from rotating on the tier that the plate 200 is placed on. The keyway 202 may be a semicircular slot with an opening in the outer edge of the slot, as shown. In this embodiment, the keyway 202 allows some rotation, e.g., about 20 to about 30 degrees of rotation, so that the keyway 202 may engage the upper support 108 to prevent lateral movement and tipping of the plate 200.

Figure 15:
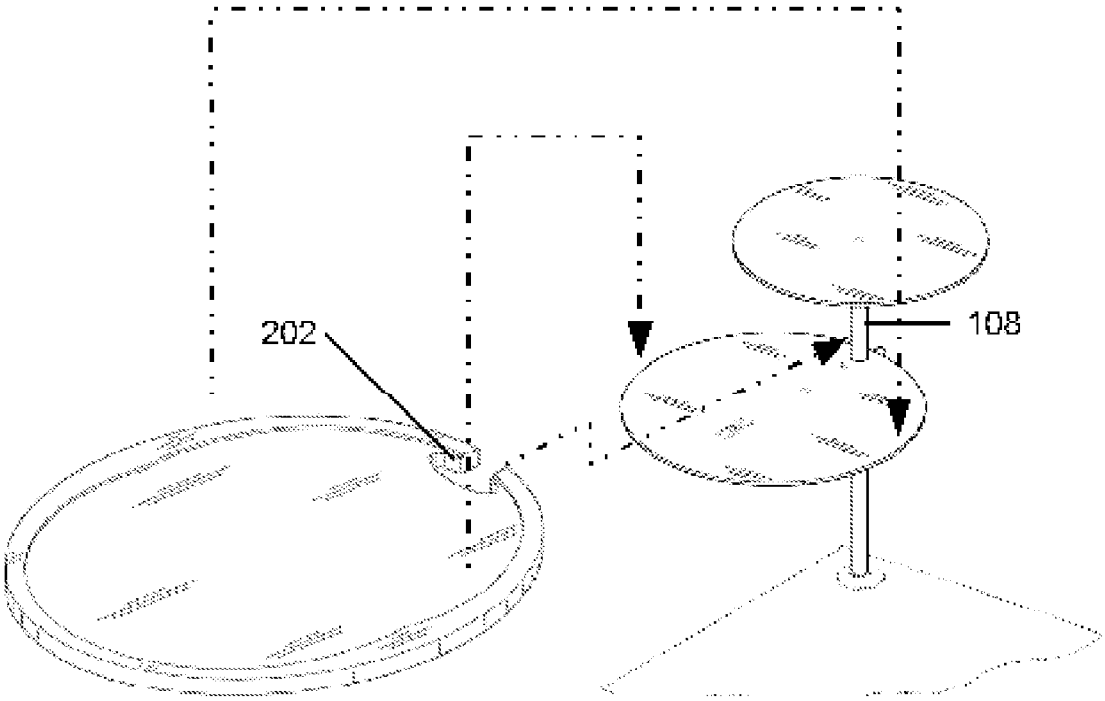
FIG. 15 depicts the extension plate being installed on one of the tiers of the tiered tray according to one embodiment of the trays discussed herein.

In one embodiment, the recess 212 is in the form of a figure "8". The figure "8" is generally a combination of two overlapping circles, as shown in FIG. 14. These two circles may have equal diameters, for example, slightly larger than the diameter of the lower and/or upper tiers 102, 104. The pinched areas in the figure "8" prevent lateral movement as discussed herein. Referring to FIG. 15, the plate 200 is used by placing the recess 212 over either the lower tier 102 or the upper tier 104. When placed on the lower tier 102, the upper support 108 is placed within the keyway 202, and the plate 200 rotated to lock the plate 200 to the lower tier 102. Removal is the reverse.

While the foregoing has been described in some detail for purposes of clarity and understanding, it will be appreciated by one skilled in the art, from a reading of the disclosure, that various changes in form and detail can be made without departing from the true scope of the invention.

What is claimed is:

1. A tiered tray comprising:

a first tier with a first support member coupled thereto;

a second tier with a second support member coupled thereto; and a table insert having a cavity therein that accepts at least one of the first and the second support members, the table insert including a spring-retractable aperture cover that retracts into an opening in the insert by placement of the first tier in the insert and covers the opening in the insert by removal of the first tier from the insert, wherein the first support member maintains a level of the first tier above a level of a table and the second support maintains a level of the second tier above the level of the first tier, and wherein the first tier is removably attachable to the table insert and the second tier is removably attachable to the first tier.

2. The tray of claim 1, wherein the support members are fixed to their respective tiers.

3. The tray of claim 1, wherein the first support member maintains the first tier from about 6" to about 12" above the level of the table.

4. The tray of claim 1, wherein the second support member maintains the second tier from about 3" to about 9" above the level of the first tier.

5. The tray of claim 1, wherein the tray does not include a tier at the level of the table.

6. The tray of claim 1, wherein the first and second tiers are usable independently and in combination.

7. The tray of claim 1, wherein at least one of the first and the second tiers have a circular, planer structure.

8. The tray of claim 7, wherein the first tier has a diameter from about 6" to about 14" and the second tier has a diameter of about 6" to about 10".

9. The tray of claim 7, wherein at least one of the first and the second tiers are unobstructed along a planer support surface of the structure.

10. The tray of claim 9, wherein the first and second tiers are usable independently and in combination, and wherein when used independently both tiers are unobstructed horizontally and when used in combination at least the second tier is unobstructed horizontally.

11. The tray of claim 1, wherein the table insert is recessed and bonded to a table top.

12. The tray of claim 1, wherein at least one of the first tier is removably attachable to the table insert and the second tier is removably attachable to the first tier with a vertically oriented slip connection.

13. The tray of claim 1, comprising an oblong extension plate having a lower surface with a recess therein that fits over at least one of the first tier and the second tier and that prevents essentially all lateral movement in the extension plate when placed over the at least one of the first tier and the second tier.

14. The tray of claim 13, wherein the at least one of the first tier and the second tier have a circular planer structure, and wherein the recess has a shape comprising a pair of overlapping circles in the form of a FIG. 8 outline, each of the overlapping circles having a diameter slightly greater than a diameter of the at least one of the first tier and the second tier.

15. The tray of claim 13, wherein the extension plate comprises a keyway at one end of the extension plate that engages with the second support.

16. The tray of claim 13, wherein the extension plate has a major axis and a minor axis, and wherein a dimension of the plate along the major axis is from about 8" to about 16", and the dimension of the plate along the minor axis is about 8" to about 14".

17. The tray of claim 1, wherein at least one of the first tier and the second tier comprise an element configured to removably secure a plate thereto.

18. A tiered tray comprising:

a first tier having a circular planer structure with a first support member fixed thereto;

a second tier having a circular planer structure with a second support member fixed thereto;

a table insert having a cavity therein that accepts at least one of the first and the second support members, the table insert including a spring-retractable aperture cover that retracts into an opening in the insert by placement of the first tier in the insert and covers the opening in the insert by removal of the first tier from the insert, wherein the first support member maintains a level of the first tier above a level of a table and the second support maintains a level of the second tier above the level of the first tier, the first tier is removably attachable to the table insert and the second tier is removably attachable to the first tier, the tiers removably attachable with a vertical slip connection, and wherein the first and second tiers are usable independently and in combination, and when used independently both tiers are unobstructed horizontally and when used in combination at least the second tier is unobstructed horizontally; and an oblong extension plate having a lower surface with a recess therein that fits over at least one of the first tier and the second tier and that prevents lateral movement in the extension plate when placed over the at least one of the first tier and the second tier.

19. A tiered tray comprising:

a first tier with a first support member coupled thereto;

a second tier with a second support member coupled thereto;

a table insert having a cavity therein that accepts at least one of the first and the second support members, wherein the first support member maintains a level of the first tier above a level of a table and the second support maintains a level of the second tier above the level of the first tier, and wherein the first tier is removably attachable to the table insert and the second tier is removably attachable to the first tier; and an oblong extension plate having a lower surface with a recess therein that fits over at least one of the first tier and the second tier and that prevents lateral movement in the extension plate when placed over the at least one of the first tier and the second tier, wherein the recess has a shape comprising a pair of overlapping circles in the form of a FIG. 8 outline, each of the overlapping circles having a diameter slightly greater than a diameter of the at least one of the first tier and the second tier.

* * * * *